United States Patent [19]

Sato

[11] 4,061,808

[45] Dec. 6, 1977

[54] COMPOSITE LABEL STRIP FOR USE WITH LABEL APPLYING APPARATUS

[75] Inventor: Yo Sato, Tokyo, Japan

[73] Assignee: Kabushiki Kaisha Sato Kenkyusho, Tokyo, Japan

[21] Appl. No.: 675,717

[22] Filed: Apr. 12, 1976

[30] Foreign Application Priority Data

Apr. 14, 1975 Japan ..... 50-49199[U]

[51] Int. Cl.[2] ..... B65D 65/28; G09F 3/00

[52] U.S. Cl. ..... 428/42; 40/2 R; 156/250; 156/252; 283/18; 283/21; 428/41; 428/40; 428/43; 428/354; 428/906

[58] Field of Search ..... 428/40, 41, 906, 914, 428/136, 43, 354, 42, 43; 40/2 R; 283/18, 21; 206/820; 156/250, 252

[56] References Cited

U.S. PATENT DOCUMENTS

| | | | |
|---|---|---|---|
| 1,642,387 | 9/1927 | Reis | 40/2 R |
| 2,095,437 | 10/1937 | Fox | 40/2 R |
| 2,303,346 | 12/1942 | Flood | 40/2 R |
| 2,845,728 | 8/1958 | Huber | 40/2 R |
| 3,825,463 | 7/1974 | Amann | 40/2 R |
| 3,852,139 | 12/1974 | Jenkins | 156/250 |
| 3,963,124 | 6/1976 | Banks | 40/2 R |

*Primary Examiner*—Ellis Robinson

*Attorney, Agent, or Firm*—Ostrolenk, Faber, Gerb & Soffen

[57] ABSTRACT

A composite label strip comprised of a strip of labels and a supporting backing strip. The backing strip is coextensive with and is releasably adhered to the underside of the label strip. The label strip is divided into a series of same size labels by a plurality of cuts transverse to the length of the strip. For every label, the label and backing strip composite also has through perforations, which pass through both strips and are arranged in one or more longitudinally separated rows transverse to the length of the strip. These rows of perforations are also separated from the transverse cuts between adjacent labels. The perforations are placed so that they may be engaged by the teeth of a feed roller. Since the perforations are longitudinally spaced from the transverse cuts, the labels can be successively peeled off smoothly from the backing strip.

8 Claims, 14 Drawing Figures

FIG.1 Prior Art
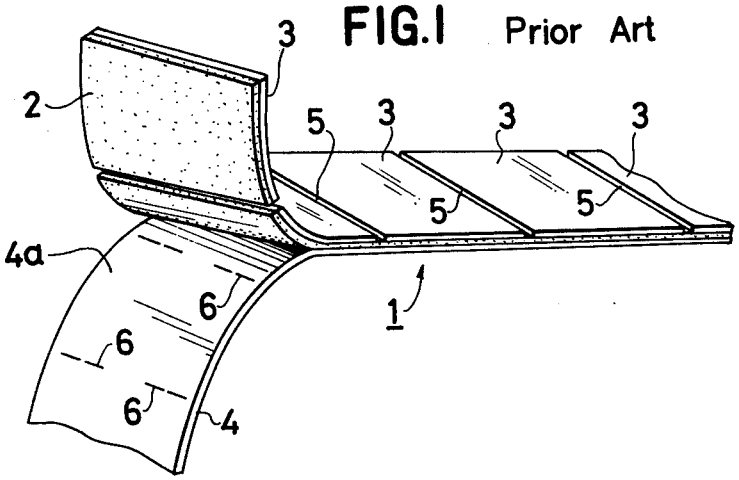
FIG.2 (A) Prior Art
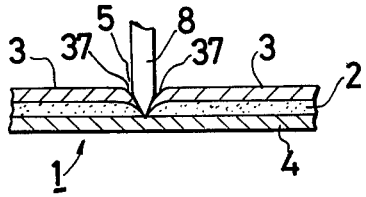
FIG.2 (B) Prior Art
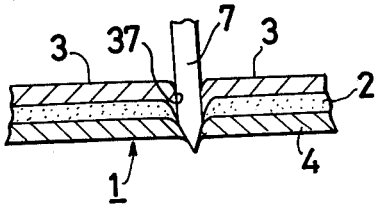
FIG.2 (C) Prior Art
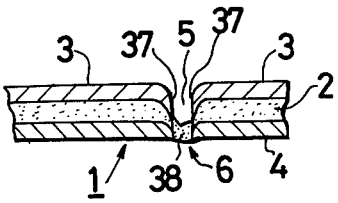

COMPOSITE LABEL STRIP FOR USE WITH LABEL APPLYING APPARATUS

BACKGROUND OF THE INVENTION

1. Field of the Invention

The invention relates to a composite label strip for use with a label applying apparatus, and more particularly, it relates to a composite label strip, in which a consecutive series of labels of the same size are releasably adhered to a backing strip.

2. Description of the Prior Art

Composite label strips are used with label applying apparatus. Such apparatus are usually equipped with a label strip feed mechanism, a printing mechanism for printing individual labels, a peeling mechanism for separating the labels from the backing strip and a peeled label applying mechanism. The feeding or advancing of the composite label strip has been conventionally accomplished by several methods. One technique uses a smooth surface feed roller. But this often results in slippage between the roller and the label strip being advanced, thus inviting incorrect feed. The printed indicia will be out of position on the labels.

To avoid this, a different composite label strip is used. The strip is formed with label feeding perforations, which are punched through both the label strip and its backing strip. These are engaged by correspondingly placed and spaced teeth formed on the feed roller. A composite label strip of this type is prepared by punching the feeding perforations through the use of a combination of concave and convex blades. Excessive force is required intermittently for the punching operation. As a result, the rotational condition of the label manufacturing machine cannot be smooth. Therefore, the rotational speed of the label strip manufacturing machine has to be slowed to such a great extent as to considerably reduce the efficiency of the production of the label strip. Moreover, a composite label strip, which has its printing surface formed with such feeding perforations, is liable to have its printed letters or symbols partially removed. For this reason, label strips of this type have not been employed in a label applying system where clear print is required.

With a view to eliminating the above drawbacks, there is another form of composite label strip, in which the label feeding perforations are formed either in the labels or in their backing strip. A composite label strip of this type is discussed later in more detail.

SUMMARY OF THE INVENTION

It is a major object of the present invention to provide an improved composite label strip structure which is free from any of the drawbacks of the prior art.

Another object of the present invention is to provide an improved composite label strip structure in which labels are smoothly released from their backing strip.

Still another object is to provide an improved composite label strip structure which can be used with labels of large size and with labels that carry many pieces of information, without any fear of tearing of the labels.

A further object is to provide an improved composite label strip structure which is simple and inexpensive to produce.

Yet another object is to provide an improved composite label strip structure which can be fed correctly.

A further object is to provide an improved composite label strip structure which effectively prevents exchange or removal of labels once they are adhered to commodities.

According to a major feature of the present invention, a composite label strip structure is provided which is comprised of a label strip and a backing strip. The backing strip is releasably adhered to the underside of the label strip in the longitudinal direction and the label strips are coextensive in shape and extent. The label strip is separated into a plurality of separate labels by a plurality of transverse cuts spaced at predetermined intervals. For every label, the label and backing strips have common through perforations which extend completely through the composite strip and which are arranged in one or more rows extending transversely across the label strip and also spaced longitudinally away from the transverse cuts between adjacent labels.

BRIEF DESCRIPTION OF THE DRAWINGS

Other objects and advantages of the present invention will become apparent from the following description taken in conjunction with the accompanying drawings, in which:

FIG. 1 is a perspective view showing one prior art composite label strip structure;

FIGS. 2 (A), (B) and (C) are longitudinal sections consecutively illustrating the formations of the cut portions, perforations and the agglutinated portions of the composite of FIG. 1;

DETAILED DESCRIPTION OF THE PRIOR ART

Figure 3:
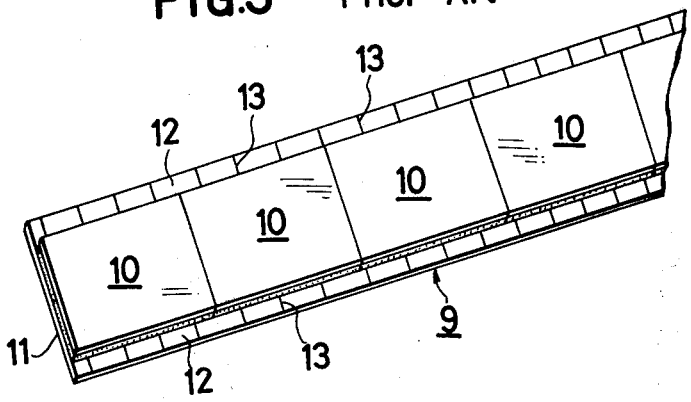
FIG.3 Prior Art
FIG. 3 is a view similar to FIG. 1 and showing another conventional composite label strip structure.

Prior to describing the present invention, several types of the conventional composite strips or webs of label material are now discussed, with reference to FIGS. 1 to 5, so that the background of the invention may be understood.

FIG. 1 shows a composite strip of label material 1. It includes a label strip having its back or underside coated with an adhesive 2. It further includes a strip 4 of supporting or backing material, which has its surface coated with a thin film 4a of releasing or parting agent, such as a smooth plastic, and which releasably adheres to and carries the label strip longitudinally and coextensively. There are a series of labels 3 which are separated from the label strip by transverse cuts 5 that are formed at equally spaced apart intervals. Transverse perforations 6 are provided for effecting advance of the composite label strip 1. They are located only in the backing strip 4 and are aligned with the transverse cuts 5 between every adjacent pair of the labels 3.

The composite label strip 1 solves the problems of transfer slippage between the feed roller and the label strip and of difficulty in obtaining clear print. But, new drawbacks arise, which are explained with consecutive reference to FIGS. 2 (A), (B) and (C). The labels 3 at first take the form of a unitary strip adhered to and carried by the backing strip 4. Then the cuts 5 are formed in the label strip at suitable intervals by means of a cutting edge 8.

When each individual label 3 and its respective adhesive layer 2 are formed by the cutting edge 8, the cut ends 37 in the cut 5 between two adjacent labels 3 extend toward the backing strip 4 and have a shape of the letter "V." At the next stage, shown in FIG. 2 (B), a perforating edge 7, comprised of cutting portions shaped to form perforations 6 is moved through the cut portion 5 and is forced into the backing strip 4 so as to form the perforations 6 in the backing strip 4. Meanwhile, the cut ends 37 of the labels 3 are being pushed further into the backing strip 4 than they were in their condition shown in FIG. 2 (A). As a result, the lower edges of the cut ends 37, together with the pushed down adhesive 2, may fill up the perforations 6 left in the backing strip 4, as can be seen from FIG. 2 (C), thereby to form agglutinated portions 38 which make it more difficult for the labels 3 to be released or peeled from the backing strip 4.

The quantity of information to be indicated on a label may be quite large. To provide for this, the surface area of the label is accordingly enlarged. In order to reliably peel off such a large size label, the system of FIG. 5 for advancing, guiding and peeling a label has been employed. Platen 19 forms an upper passage 20 together with upper guide plate 22 and forms a lower passage 21 together with lower guide plate 23, which is spaced from plate 22. A label peeling section 24 is located forward of the leading end of the platen 19 and in the space defined between the leading or forward lower end of the upper guide plate 22 and the leading or forward upper end of the lower guide plate 23.

Figure 5:
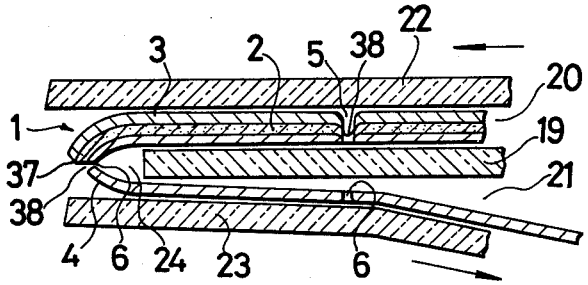
FIG.5 Prior Art
FIG. 5 is a longitudinal cross-sectional view of the location where labels, which are part of a conventional composite label strip structure in FIG. 1 are peeled from the backing strip.

In the construction of FIG. 5, the entire composite label strip 1 is guided to pass forwardly through the upper passage 20. Then the backing strip 4 is reversed, forming a "U" within the peeling section 24. The backing strip 4 is then transferred rearwardly through the lower passage 21 in the direction of the lower arrow.

As has been described above, the leading cut end 37 of the label 3 forms the portion 38, which is agglutinated to the backing strip 4 by the adhesive 2, while the perforations 6 are arranged in line with the cut portion 5 of that label 3. This interferes with delamination or peeling of the labels. Upon the start of its peeling, the leading label 3 may be turned over or reversed within the peeling portion 24, while remaining in contact with and not being peeled from the backing strip 4. Then the label is transferred backward through the lower passage 21 along with the backing strip 4.

Because the perforations 6 by which the backing strip 4 is advanced are located in positions aligned with the cut ends 37 of the labels, the backing strip 4 is bent sharply at the perforations 6 in the peeling section 24 because there is little stiff material to stop such bending. Thus, the backing strip 4 is liable to be torn at the perforations 6 because there is an excessive concentration of forces there. Likewise, formation of such sharp bends at perforations 6 prevents the backing strip 4 from being smoothly reversed and advanced or fed.

Because the edges of the label cut ends 37 are agglutinated at 38 to the backing strip 4 by means of the adhesive 2, the ability to peel the labels will be even more adversely affected in the case when the surface areas of the labels 3 are larger or where there is high humidity where the label applying operation is performed.

In order to effect correct transfer of the composite label strip without undesirable deformation of the cut ends 37 of the labels 3, it becomes necessary to employ labels and a backing strip which are made of excessively strong materials. This results in a large increase in the production costs of the composite label strip. Moreover, a thin, but strong, material is expensive, while a thick, strong material has undesirably large winding bulk, while also being expensive.

To overcome those drawbacks, another composite type label strip has been proposed, as explained with reference to FIG. 3. Here, a feeding force is exerted directly only upon the backing strip during the advancing of the composite label strip. The labels are not deformed and the backing strip is not torn at the perforations as occurred with the previous arrangement. The composite label strip 9 includes a series of labels 10, which are all cut to the same size. Each label has its back coated with an adhesive. Labels 10 are adhered to and laminated on the center portion of a backing strip 11 in an end-to-end fashion in the longitudinal direction. Backing strip 11 is wider than the strip of labels 10. In the marginal side edges 12 extending along both sides of the center portion of the backing strip are formed a series of slits 13, which are provided for label feeding purpose. Slits 13 are arranged at equally spaced intervals along strip 11, which intervals are shorter than the length of the labels 10.

Because of the shortness of the intervals between the slits 13, the engaging areas between these slits 13 and their driving teeth are accordingly increased in number for one sheet of the labels 10, Thus, the backing strip 11 can perform its function quite satisfactorily even if it is made of a relatively weak material.

But, the composite label strip of FIG. 3 has the drawback that it increases the difficulty of operating its label applying apparatus. The working capacity of a label applying apparatus is increased as the label strip is widened by the side margins 12. This drawback makes it impractical to use larger surface area labels, even when inclusion of more information is desired. In addition, this composite label strip cannot be produced at a reasonable cost because of the greater quantity of backing strip material that must be used. Therefore, the composite label strip of FIG. 3 has not been put into actual use.

Figure 4:
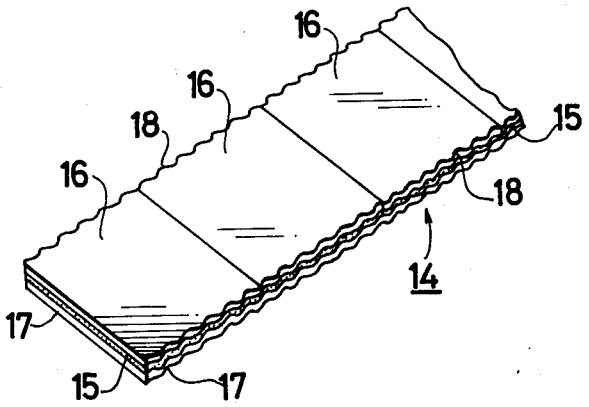
FIG.4 Prior Art
FIG. 4 is also a view similar to FIG. 1 and showing still another conventional composite label strip structure.

FIG. 4 shows still another conventional composite label strip 14. Strip 14 includes a series of labels 16, which are cut to equal size and each of which has its back surface coated with an adhesive 15. Labels 16 are adhered to a backing strip 17 in the longitudinal direction and in an end-to-end relationship. Both side edges of the labels 16 and the backing strip 17 are formed with indentations or teeth 18, which receive the label strip feeding means.

However, a composite label strip 14 with indented sides is produced at a slower working rate than the work rate for a more usual label strip having flat sides. The resulting increased production cost has also kept such a structure from common use.

DESCRIPTION OF THE PREFERRED EMBODIMENTS

Figure 6:
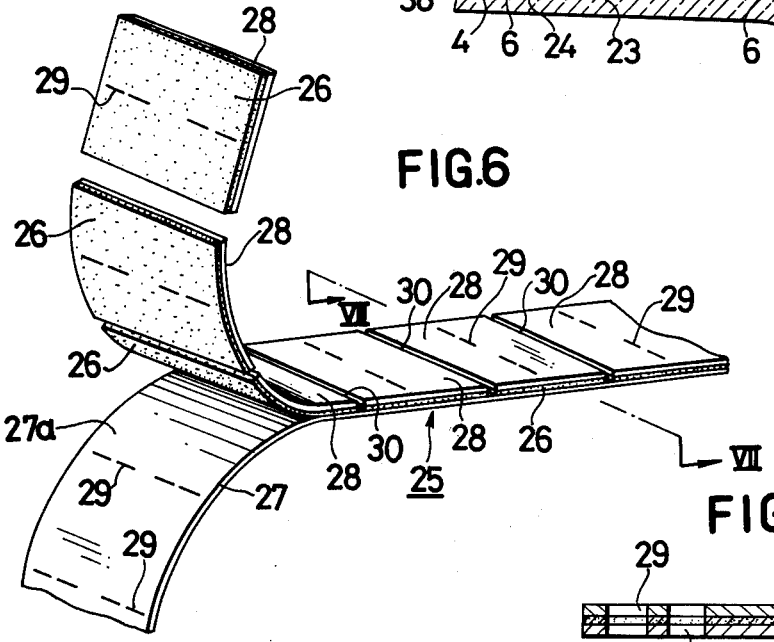
FIG. 6 is a perspective view showing a composite label strip structure according to the present invention.
Figure 12:
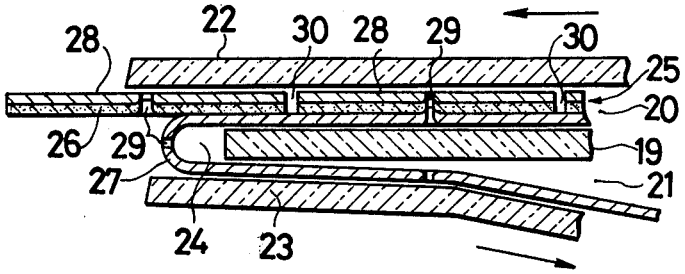
FIG. 12 is an enlarged longitudinal sectional view illustrating how label peeling of the composite label strip structure of FIG. 6 according to the present invention is performed.

The present invention is now described in several preferred embodiments, with reference to FIGS. 6 and 12.

Figure 7:
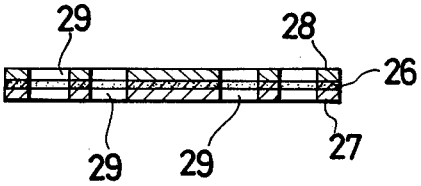
FIG. 7 is an enlarged longitudinal sectional view taken along the line VII—VII of FIG. 6.

In FIG. 6, composite label strip 25 is comprised of a label strip, having a lower surface that is coated with an adhesive 26, and of a backing strip 27, having a top surface coated with a thin film 27*a* of a releasing agent. The releasing film 27*a* is adhered to the label adhesive 26 and the backing strip is releasably adhered longitudinally to the label strip in a coextensive fashion. The label strip comprises a series of labels 28, which are separated from neighboring labels in the strip at equally spaced intervals by a cutting operation which forms cut portions 30 in the strip. As seen in FIGS. 6 and 7, a respective plurality of feeding perforations 29 arranged in a row transverse to the direction of extension of the label strip are formed in and pass completely through each label in the composite label strip 25. The size and number of the perforations 29 in any row can be selected suitably for a particular application.

The feeding perforations extending through the labels and the backing strip comprise several slits through one label so that the feeding force can be distributed suitably without an undesired concentration of force. Thus, even if the labels are so large that they can carry many pieces of information, including prices, kinds, contents, quantity, manufacture date, source or other codes, they can be smoothly fed and peeled off the backing strip.

Each row of perforations 29 is spaced away from the cut portions 30 between the labels 28. Each row of spaced perforations 29 is preferably arranged on a transverse line which runs substantially across the center of its respective label 28. This composite label strip 25 is quite simple and can be made at a low cost. Yet, all of the drawbacks accompanying the conventional label strips can be eliminated.

An advantage of the present invention is that the labels of such a composite label strip 25 can have as large an area as needed to carry many pieces of information. Also, the label strip 25 can be used satisfactorily under high humidity conditions because the label strip feeding operation can be performed without adversely affecting the cut portions 30.

Figure 10:
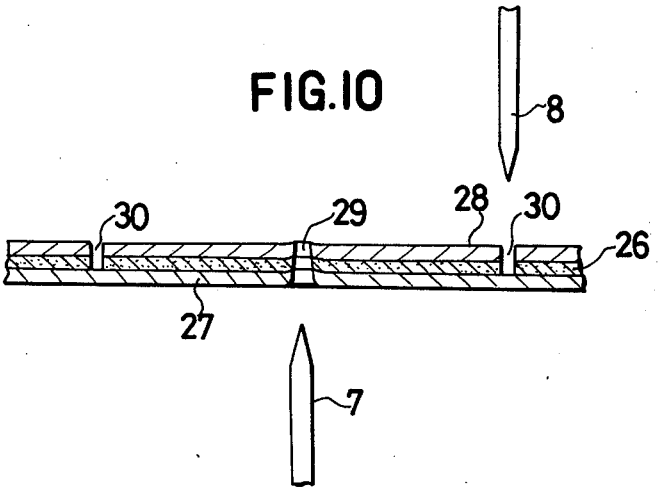
FIG. 10 is an enlarged longitudinal sectional view showing the cut portions and the perforations of the composite label strip structure of FIG. 6.
Figure 11:
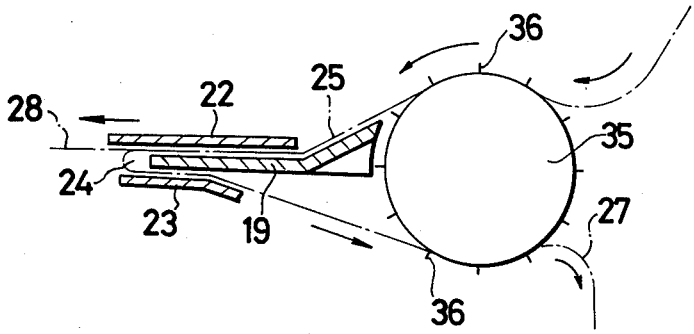
FIG. 11 is an explanatory view illustrating the engagement between the perforations of the composite label strip structure of FIG. 6 and the teeth of a feed roller and also showing the feeding and peeling operations of the composite label strip structure.

Another advantage of the invention is discussed in connection with FIGS. 10 and 11. In FIG. 10, the perforations 29 have a cross-section in the form of an inverted "V," which converges upwardly. This results when the perforations are formed by pushing the perforating edge 7 from the underside of the backing strip 27 into the labels 28. With such a cross-sectional shape, the perforations 29 can be reliably engaged by thin teeth 36, which project from the circumference of a feed roller 35, as shown in FIG. 11. This assures sufficient feed.

Because the backing strip 27 and the labels 28 are laminated, a greater force is required to peel the labels 28 from the backing strip 27 as the area of the labels becomes larger. However, the perforations 29 are not aligned with the cut portions 30 of the labels 28. Thus, the agglutinated portions 38 between the label cut ends 37 and the backing strip 4 that were discussed with reference to FIGS. 2 (C) and 5 are not found at the leading ends of the labels 28. This makes it possible to smoothly start the peeling of the leading label 28 from the backing strip 27.

After this first label is started, the perforations 29 arrive at the peeling section 24 in the manner shown in FIG. 12. At the instant shown, a strong force is not required for the feeding operation, and the force to be exerted upon the perforations 29 can be quite weak, because there is no agglutinated portion 38 in the cut portions of the labels 28 or in the backing strip 27, as is apparent from FIG. 10. As a result, a backing strip 27 made only of a thin economical film can be used satisfactorily.

Figure 8:
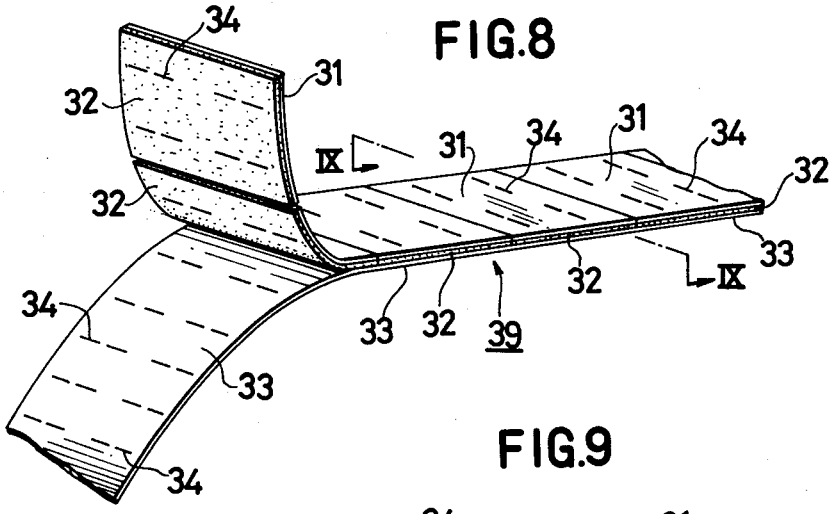
FIG. 8 is a view similar to FIG. 6 and showing another embodiment of the present invention.
Figure 9:
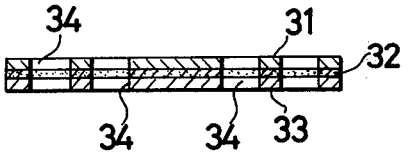
FIG. 9 is an enlarged longitudinal sectional view taken along the line IX—IX of FIG. 8.

Another embodiment of the present invention is described with reference to FIGS. 8 and 9. This embodiment is similar to the one described in connection with FIG. 6. The composite label strip 39 has a greater number of rows of perforations. The composite label strip is comprised of a series of cut labels 31 of the same size, an adhesive layer 32 applied to the backs of the labels 31, and a common backing strip 33 of the same width as the labels 31. The labels 31 are adhered in an end-to-end relationship along the longitudinal direction of the backing strip 33 by the adhesive layer 32. A plurality of transversely oriented rows of feeding perforations 34 are provided for each of the labels 31, with two transverse and parallel rows each having four slit perforations being illustrated. Although two transverse rows each composed of four slits are shown, the invention is not limited to this arrangement or number of rows or perforations therein. The positions and arrangement of the feeding perforations can be determined in accordance with the characteristics of preset letters and/or symbols to be printed upon each of the labels.

The positions for the rows of feeding perforations can be selected with relative freedom because the rows of perforations need not be located in line with the cut portion between any two adjacent labels. Thus, great precision is not required in placing the perforations. The efficiency of manufacture of a composite label strip is greatly improved. Since the positions and numbers of the feeding perforations can be selected suitably, the composite label strip of the invention can be subjected to the peeling operation more smoothly than for the conventional label strip even if the label applying apparatus is used in a place where the humidity is high.

FIG. 12 illustrates the label peeling operation for a composite label strip according to the invention. For this illustration, the composite label strip 25 of the embodiment shown in FIG. 6 is used in FIG. 12 to explain label peeling. In the label peeling apparatus, the upper passage 20 and the lower passage 21 are formed between the upper guide plate 22 and the platen 19 and between the platen 19 and the lower guide plate 23, respectively. The label peeling section 24 of the apparatus is a space defined by the leading lower end of the upper guide plate 22, the leading upper end of the lower guide plate 23 and the leading end of the platen 19. After the composite label strip 25 has passed through the upper passage 20, only the backing strip 27 is reversed within the peeling section 24 and the backing strip is advanced through the lower passage 21 in the direction of the arrow.

With the labels 28, the perforations 29 are not positioned in line with the label cut portions 30. Thus, the leading end of the foremost label 28 is temporarily or releasably adhered to the backing strip 27 by the action of the adhesive layer 26 between. This arrangement is quite different from the conventional example as shown in FIGS. 2 and 5, in which the leading end of the foremost label is agglutinated to or pressed into the perforations 29 of the backing strip at 38. In the composite label strip of the present invention, moreover, the backing strip 27 has no perforations in the vicinity of the leading end of the foremost label. Thus, the leading ends of the labels 28 are successively advanced into the peeling section 24 and then are peeled from the backing strip 27. When this peeling operation is to be started, not only the labels 28 themselves but also the backing strip 27 can benefit from the rigidities of their materials, so that the peeling operation can be smoothly effected from the leading end of every label.

It is a primary result of the present invention that each of the labels can be smoothly peeled from its backing strip. This is because the label strip feeding perforations, which extend through the labels and the backing strip, are formed in positions away from the cut portions separating the labels and accordingly because the cut ends are not agglutinated to the perforations of the backing strip through an adhesive.

As a further benefit of the composite label strip of the invention, a label peeled from the composite label strip has the lined perforations formed at and passing through its surface. The label is liable to be torn at the perforations when it is peeled from the surface of a commodity. Thus, people cannot improperly interchange or replace labels between expensive and inexpensive goods at a shop counter.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A composite label strip structure comprising:

a label strip extending in a longitudinal direction and having a top side and an underside;

a backing strip that is oriented to extend in said longitudinal direction and that is substantially coextensive in shape and in placement with said label strip; said backing strip having a surface that is releasably adhered to said underside of said label strip;

said label strip having a plurality of cuts therethrough extending from said top side to said under side thereof, each said cut extending transversely of said longitudinal direction of extension of said label strip; said cuts being spaced at predetermined intervals along said label strip in said longitudinal direction; at said cuts, said label strip is separable into a series of labels;

the composite structure of both said label strip and said backing strip having common through perforations, each extending from said backing strip bottom side and continuing through said backing strip to the top side thereof; and each converging into said label strip; for each said label, there is at least one row of said perforations, and each said row of perforations extending transversely of said longitudinal direction of extension of said label strip; all said rows of perforations through the composite strip structure being spaced longitudinally away from said cuts between labels.

2. A composite label strip structure according to claim 1, further comprising an adhesive layer applied to said underside of said label strip to effect adhesion between said label strip and said backing strip.

3. A composite label strip structure according to claim 2, further comprising a film of a releasing agent applied to said surface of said backing strip so as to enable the release of said labels from said backing strip.

4. A composite label strip structure according to claim 1, wherein said intervals between adjacent said cuts are identical.

5. A composite label strip structure according to claim 1, wherein each said row of said perforations is positioned substantially at the transverse center line between the two adjacent said cuts.

6. A composite label strip structure according to claim 1, wherein said through perforations have longitudinal cross sections measured along said longitudinal direction, which converge from a greater width to a narrower width, moving from said backing strip into said label strip.

7. A composite label strip structure according to claim 1, wherein for each said label, there are two spaced apart said rows of said perforations, and both said rows of perforations for a said label being between and spaced from the two adjacent said cuts forming the respective said label.

8. A composite label strip structure according to claim 7, wherein each said row of perforations is comprised of four slits extending transversely of said label strip.

* * * * *